US005318204A

United States Patent [19]

Davis et al.

[11] Patent Number: 5,318,204

[45] Date of Patent: Jun. 7, 1994

[54] RESILIENT SQUEEZE BOTTLE EMPLOYING AIR CHECK VALVE WHICH PERMITS PRESSURE EQUILIBRATION IN RESPONSE TO A DECREASE IN ATMOSPHERIC PRESSURE

[75] Inventors: Leane K. Davis, Milford; Eric J. Holden; Robert S. Kiner, both of Cincinnati; Joan B. Szkutak, West Chester, all of Ohio

[73] Assignee: The Proctor & Gamble Company, Cincinnati, Ohio

[21] Appl. No.: 39,658

[22] Filed: Mar. 30, 1993

Related U.S. Application Data

[63] Continuation of Ser. No. 712,007, Jun. 7, 1991, abandoned.

[51] Int. Cl.[5] ..... B65D 35/28; B65D 37/00

[52] U.S. Cl. ..... 222/95; 222/105; 222/212; 222/481.5

[58] Field of Search ..... 222/95, 105, 212, 386.5, 222/481.5

[56] References Cited

U.S. PATENT DOCUMENTS

| | | | |
|---|---|---|---|
| 1,122,868 | 12/1914 | Davis | 222/490 |
| 1,206,661 | 11/1916 | Booth | 222/490 |
| 1,242,654 | 10/1917 | Chapman | 222/490 |
| 1,491,860 | 4/1924 | Holden | 222/104 |
| 1,631,931 | 6/1927 | Geake | 222/104 |
| 1,854,458 | 4/1931 | De Quincy et al. | 222/386.5 |
| 1,859,397 | 5/1932 | Johnson et al. | 222/490 |
| 1,989,145 | 1/1935 | Newby | 221/60 |
| 2,557,120 | 6/1951 | Knoblock | 169/31 |
| 2,608,320 | 8/1952 | Harrison, Jr. | 222/95 |
| 2,679,336 | 10/1950 | Frick | 222/386.5 |
| 2,715,980 | 8/1955 | Frick | 222/386.5 |
| 2,743,038 | 4/1956 | Ferries | 222/95 |
| 2,759,636 | 8/1956 | Albert et al. | 222/103 |
| 2,777,612 | 1/1957 | Bensen | 222/209 |
| 2,804,995 | 9/1957 | Fee | 222/95 |
| 2,944,705 | 7/1960 | Strumor | 222/94 |
| 3,055,553 | 9/1962 | Mapes et al. | 222/95 |
| 3,067,787 | 12/1962 | Salk | 141/321 |
| 3,081,066 | 3/1963 | Land | 222/212 |
| 3,223,289 | 12/1965 | Bouet | 222/209 |
| 3,258,175 | 6/1966 | Taylor | 222/380 |
| 3,262,605 | 7/1966 | Madden et al. | 222/103 |
| 3,275,193 | 9/1966 | Barr | 222/1 |
| 3,295,725 | 1/1967 | Brandt | 222/107 |
| 3,306,500 | 2/1967 | Williams | 222/209 |
| 3,319,837 | 1/1967 | Mueller | 222/386.5 |
| 3,332,579 | 7/1967 | Peters | 222/96 |
| 3,339,803 | 9/1967 | Wayne et al. | 222/95 |
| 3,360,169 | 12/1967 | Susuki et al. | 222/482 |
| 3,381,857 | 5/1968 | Francis | 222/100 |
| 3,592,360 | 7/1971 | Aleck | 222/95 |
| 3,592,365 | 7/1971 | Schwartzman | 222/209 |
| 3,669,323 | 6/1972 | Harker et al. | 222/490 |
| 3,674,183 | 7/1972 | Venable et al. | 222/212 |
| 3,675,822 | 7/1972 | Casali et al. | 222/103 |
| 3,731,844 | 5/1973 | Baker | 222/83 |
| 3,767,078 | 10/1973 | Gortz | 220/63 R |

(List continued on next page.)

FOREIGN PATENT DOCUMENTS

| | | | |
|---|---|---|---|
| 1017080 | 10/1957 | Fed. Rep. of Germany | 222/490 |
| 2364168 | 4/1978 | France | 222/495 |

*Primary Examiner*—Andres Kashnikow
*Assistant Examiner*—Kenneth Bomberg
*Attorney, Agent, or Firm*—E. Kelly Linman; Dean L. Garner

[57] ABSTRACT

A resilient squeeze bottle dispensing package including an internal flexible bag which is suitable for dispensing viscous product such as toothpaste, but which includes an air valve which will automatically permit pressure equilibration in the chamber formed between the flexible bag and the interior of the bottle in response to a decrease in the atmospheric pressure surrounding the package. Employing a valve which permits such automatic pressure equilibration avoids unwanted oozing of viscous product from the discharge orifice of the package when the atmospheric pressure surrounding the package decreases, e.g., as by airplane travel or by travelling from a first elevation to a second substantially higher elevation.

7 Claims, 6 Drawing Sheets

U.S. PATENT DOCUMENTS

| | | | |
|---|---|---|---|
| 3,833,154 | 9/1974 | Markowitz | 222/212 |
| 3,837,533 | 9/1974 | Splan | 222/94 |
| 3,908,863 | 9/1975 | White | 222/103 |
| 3,915,342 | 10/1975 | Van Bussel | 222/103 |
| 3,931,834 | 1/1976 | Caillet | 138/30 |
| 3,936,334 | 2/1976 | Kushida et al. | 156/69 |
| 3,938,706 | 2/1976 | Cohen | 222/83.5 |
| 3,995,772 | 12/1976 | Liautaud | 222/83.5 |
| 4,020,978 | 5/1977 | Szczepanski | 222/209 |
| 4,027,784 | 6/1977 | Mattson | 222/102 |
| 4,089,437 | 5/1978 | Chutter | 222/94 |
| 4,098,434 | 7/1978 | Uhlig | 222/94 |
| 4,102,476 | 7/1978 | Loeffler | 222/212 |
| 4,133,457 | 1/1979 | Klassen | 222/212 |
| 4,154,366 | 5/1979 | Acres | 222/95 |
| 4,295,582 | 10/1981 | Acres | 222/213 |
| 4,457,453 | 7/1984 | Stevens et al. | 222/48 |
| 4,469,250 | 9/1984 | Evezich | 222/95 |
| 4,513,891 | 4/1985 | Hain et al. | 222/213 |
| 4,562,942 | 1/1986 | Diamond | 222/386.5 |
| 4,657,151 | 4/1987 | Cabernoch | 215/11 |
| 4,671,428 | 6/1987 | Spatz | 222/105 |
| 4,728,006 | 3/1988 | Drobish et al. | 222/213 |
| 4,760,937 | 8/1988 | Evezich | 222/95 |
| 4,842,165 | 6/1989 | Van Coney | 222/95 |
| 4,909,416 | 3/1990 | Evezich | 222/386.5 |

Fig. 2
(PRIOR ART)
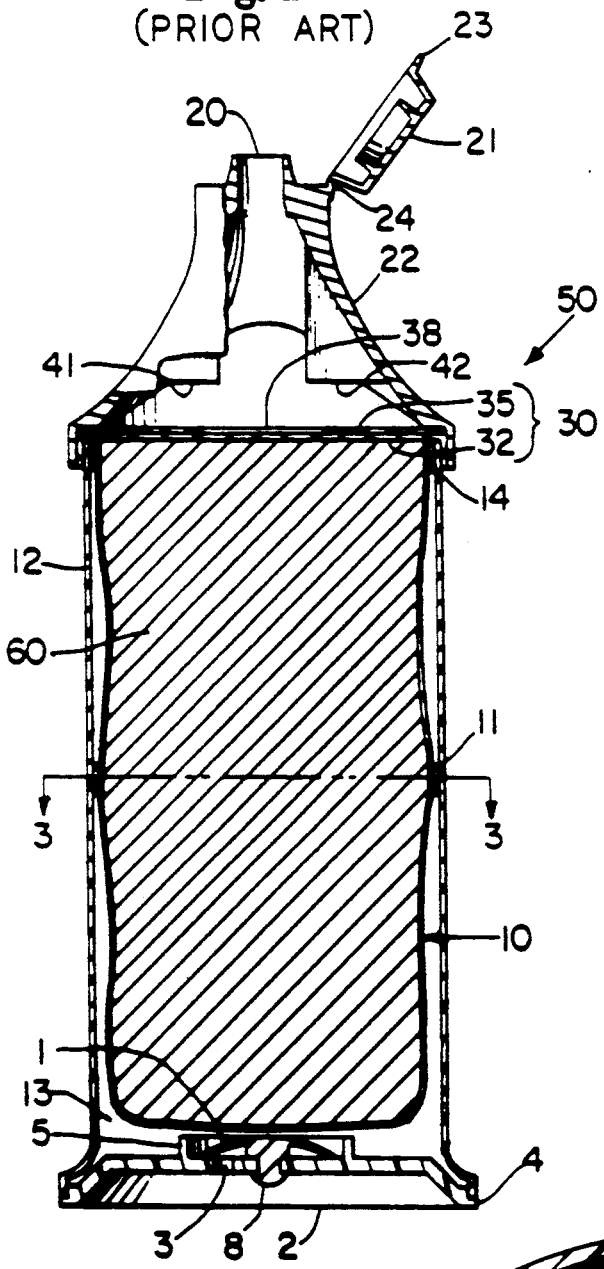
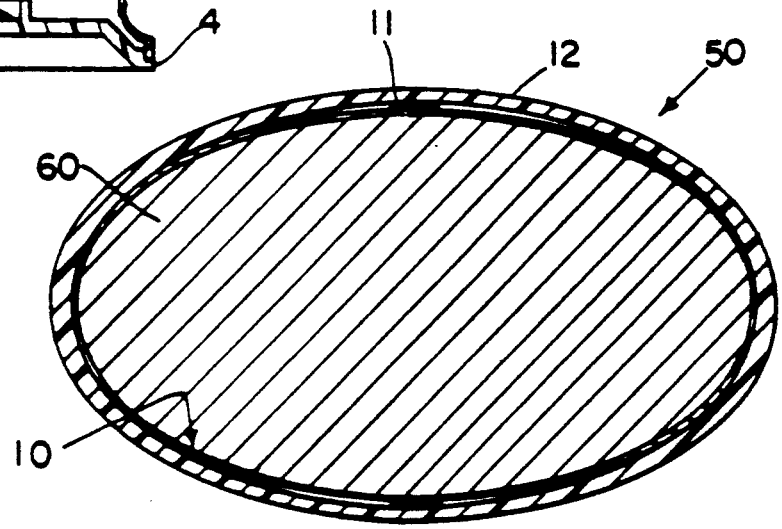
Fig. 3
(PRIOR ART)

RESILIENT SQUEEZE BOTTLE EMPLOYING AIR CHECK VALVE WHICH PERMITS PRESSURE EQUILIBRATION IN RESPONSE TO A DECREASE IN ATMOSPHERIC PRESSURE

CROSS REFERENCE TO RELATED APPLICATION

This application is a continuation of U.S. Ser. No. 07/712,007, filed Jun. 7,1991, now abandoned.

TECHNICAL FIELD

The present invention has relation to a resilient squeeze bottle dispensing package which is suitable for dispensing viscous products such as toothpaste.

The present invention has further relation to such a dispensing package which includes an air check valve which will permit gradual pressure equilibration in response to a gradual decrease in atmospheric pressure without causing viscous product to ooze from the discharge orifice of the squeeze bottle.

The present invention has still further relation to such a dispensing package which provides sharper cut-off of viscous product flow at the end of each dispensing cycle, as well as more complete emptying of the viscous product contents of the package.

BACKGROUND OF THE INVENTION

Viscous materials, such as toothpaste, are commonly packaged in collapsible tubes which offer the advantages of low cost and ease of use. However, consumer satisfaction with tubes has been limited by their messiness and their appearance during storage and use. In addition, they can be inconvenient to store because they occupy a large area when laid flat.

More recently, mechanical pumps have been introduced with some success because they overcome the negative of poor appearance during use and provide ease of storage. However, their acceptance has been somewhat limited by poor economy and the difficulty they present in dispensing product. As a result, considerable interest has been shown in the use of resilient squeeze bottle packages for dispensing viscous products.

One such resilient squeeze bottle package which has been well received is disclosed in commonly assigned U.S. Pat. No. 4,842,165 issued to Van Coney on Jun. 27, 1989. The commonly assigned Van Coney patent discloses a resilient squeeze bottle dispensing package capable of dispensing viscous products without excessive air entrainment and belching on successive dispensing cycles. In a preferred embodiment, the viscous product is suspended inside a resilient squeeze bottle in a thin flexible bag. The flexible bag is secured about its perimeter to the interior of the squeeze bottle at its top and approximately at its midpoint to facilitate both complete emptying of product and desirable suckback characteristics when the opposed squeezing forces are removed from the resilient outer wall of the bottle. A suckback valve is preferably located between the dispensing orifice in the shroud of the package and the flexible bag to limit the amount of air which can enter the package through the dispensing orifice at the conclusion of each dispensing cycle and to prevent slumping of viscous product remaining in the shroud into the bottom of the flexible bag between dispensing cycles. An air check valve is preferably provided in the bottom of the resilient squeeze bottle to facilitate a pressure buildup within the bottle when opposed squeezing forces are applied to the bottle.

While the resilient squeeze bottle package disclosed by Van Coney has been found to function extremely well, an unexpected problem has been encountered with certain embodiments of the Van Coney package when the atmospheric pressure surrounding the package decreases. This would normally be the case when a package manufactured substantially at sea level is taken along during air travel to an elevation over 5000 feet above sea level or, for example, when the user transports the package via ground travel from a first elevation where the package has become equilibrated to the surrounding atmosphere to a substantially higher elevation in a relatively short period of time, e.g., as would be the case in driving from Denver, Colorado (elevation approximately 5,000 feet above sea level) to Aspen, Colorado (elevation approximately 8,000 feet above sea level).

Because the air check valve used in a particularly preferred embodiment of the Van Coney package traps air in the variable volume chamber formed between the bottom of the flexible bag and the inside of the resilient squeeze bottle when the surrounding atmospheric pressure decreases, the pressure differential acting upon the flexible bag may become sufficient to cause the viscous product to ooze from the dispensing orifice in the squeeze bottle in the event the closure is not tightly secured thereto. Furthermore, even if the closure is tightly secured during travel, the pressure differential which will exist at the time the closure is ultimately removed will cause uncontrollable oozing of viscous product from the dispensing orifice of the squeeze bottle until such time as the air pressure in the variable volume chamber of the package reaches equilibrium with that of the surrounding atmosphere.

OBJECTS OF THE INVENTION

A primary object of the present invention is to provide a resilient squeeze bottle package which can easily and reliably dispense viscous product such as toothpaste, but which is not subject to the oozing problems described above when the atmospheric pressure surrounding the package decreases.

Another object of the present invention is to provide such a package which substantially preserves the quick dispensing and elastic recovery response imparted to the package by the use of an air check valve of the type disclosed in the aforementioned Van Coney patent, but which avoids the oozing problems described above.

DISCLOSURE OF THE INVENTION

A package in accordance with the present invention contains a viscous product, such as toothpaste, in a thin flexible bag which is suspended inside a resilient squeeze bottle. The bag is preferably secured about its periphery to the interior of the squeeze bottle at its top and approximately at its midpoint to facilitate both substantially complete emptying of product from the bag as well as desirable suckback characteristics when the squeezing force is removed from the bottle. A suckback valve is preferably located between the dispensing orifice of the bag to limit the amount of air which can enter through the dispensing orifice at the conclusion of each dispensing cycle. An air check valve is preferably provided in the resilient squeeze bottle to facilitate a rapid pressure buildup in the variable volume chamber between the flexible bag and the interior of the bottle when external squeezing forces are applied to the bottle.

When the bottle is squeezed, the air check valve closes. Air pressure builds up inside the bottle and exerts pressure on the flexible bag and its contents, causing the suckback valve to open and viscous product in the bag to pass through the suckback valve and be dispensed through the dispensing orifice. When the squeezing forces on the bottle are released, the resilient outer sidewalls of the squeeze bottle spring back toward their undeformed position, carrying the flexible bag secured thereto at its midpoint along with them. This action sharply cuts off the flow of viscous product from the dispensing orifice and causes air to enter the dispensing orifice. It also causes the suckback valve to close, thereby limiting the amount of air allowed to enter the package through the dispensing orifice. In addition, air is drawn through the air check valve which is preferably located in the bottom of the outer container, into the variable volume chamber formed between the bottom of the flexible bag and the interior of the squeeze bottle. This collapses the bottom portion of the bag by an amount substantially corresponding to the volume of viscous product dispensed. Limiting the amount of air drawn into the dispensing orifice with the suckback valve permits subsequent dispensing of product, without belching or spurting due to entrained air, on the first squeeze of the bottle.

In the practice of the present invention, the air check valve which is employed retains substantially all of the aforementioned desirable dispensing characteristics, and in addition permits air trapped in the variable volume chamber formed between the flexible bag and the interior of the resilient squeeze bottle to escape through the valve when the pressure of the surrounding atmosphere drops below the pressure inside the chamber. It thereby allows pressure equilibration to occur between the chamber and the surrounding atmosphere in response to a decrease in the atmospheric pressure surrounding the resilient squeeze bottle before a pressure differential sufficient to cause uncontrolled oozing of viscous product from the dispensing orifice of the package can be developed.

In addition, some highly unexpected benefits are achieved in the practice of the present invention relative to otherwise identical packages which are constructed generally in accordance with the teachings of the aforementioned commonly assigned U.S. Pat. No. 4,842,165 to Van Coney. In particular, such packages of the present invention typically exhibit sharper cut-off of viscous product flow from the discharge orifice of the package when the squeezing forces are removed therefrom as well as more complete emptying of the package contents. While not wishing to be bound, it is believed that these benefits result from more rapid restoration of the resilient squeeze bottle to its undeformed condition whenever the squeezing forces are removed from the package. This is caused by the more rapid pressure equilibration which occurs between the variable volume chamber inside the package and the surrounding atmosphere at the end of each package squeezing cycle. This quicker recovery time of the resilient squeeze bottle causes more rapid and hence cleaner cut-off of viscous product flow at the discharge orifice of the package, as well as more rapid and consequently more complete inversion of the flexible bag about its midpoint. More complete inversion of the flexible bag about its midpoint will, of course, produce more complete emptying of the package's viscous product contents.

Still, another unexpected benefit which results from the quicker recovery time exhibited by resilient squeeze bottle packages of the present invention is that the user can rapidly dispense successive dollops of viscous product from the package without excessive waiting for the squeeze bottle to recover to its undeformed condition between successive squeezing cycles.

BRIEF DESCRIPTION OF THE DRAWINGS

While the specification concludes with claims particularly pointing out and distinctly claiming the present invention, it is believed the present invention will be better understood from the following description in which:

FIG. 2 is a simplified partial cross-sectional view of the prior art dispenser of FIG. 1 shown in an assembled condition;

FIG. 3 is a simplified cross-sectional view of the prior art dispenser of FIGS. 1 and 2 taken at a point corresponding to section line 3—3 of FIG. 2;

DETAILED DESCRIPTION OF THE PRESENT INVENTION

Figure 1:
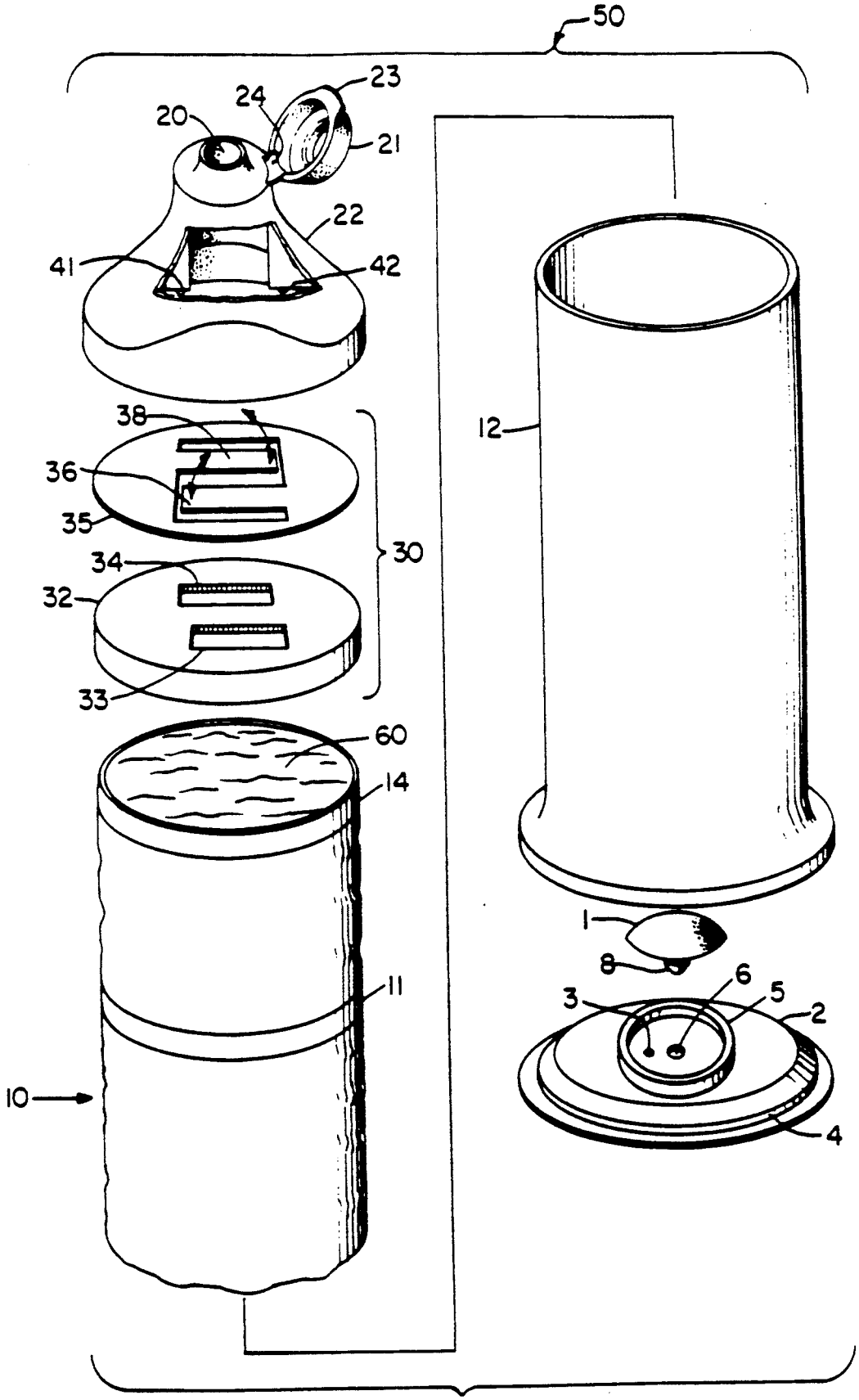
Fig. 1 (PRIOR ART)
FIG. 1 is a simplified exploded view of a preferred resilient squeeze bottle dispensing package of the prior art to which the present invention has particular relevance.

FIG. 1 is a simplified exploded view of a prior art resilient squeeze bottle dispensing package 50 of the type generally disclosed in commonly assigned U.S. Pat. No. 4,842,165 issued to Van Coney on Jun. 27, 1989 and hereby incorporated herein by reference. The basic elements comprising the prior art package 50 illustrated in their assembled condition in the cross-section of FIGS. 2-3 are: (1) resilient outer wall 12; (2) base 2 to which the lowermost end of resilient outer wall 12 is sealing secured; (3) full length flexible inner bag 10 containing viscous product 60 secured about its periphery to resilient outer wall 12 at its top edge 14 (preferably continuously) and at a point 11 (preferably intermittently) approximately intermediate the two ends of the resilient outer wall; (4), suckback valve 30 comprising an orifice plate 32 containing orifices 33 and 34 and a flexplate 35 containing resilient flaps 36 and 38 which, in their closed position, block orifices 33 and 34, respectively; (5) air check valve 1, which is used to regulate the flow of air to and from the variable volume chamber 13 formed below the flexible bag 10 and the interior of the package 50; (6) shroud 22, containing a viscous product dispensing orifice 20; and (7) closure member 21 hingedly secured to shroud 22.

In order to ensure that pressure is exerted on viscous product 60 contained within flexible bag 10 whenever opposed squeezing forces are applied to the resilient outer wall 12 of the package 50, resilient air check valve 1 stops the flow of air from the variable volume chamber 13 formed between the bottom of the flexible bag 10 and the interior of the package 50 to the surrounding atmosphere.

The application of pressure in chamber 13 of the package causes the uppermost portion of resilient air check valve 1 to seat tightly over the area of the base 2 containing aperture 3, thereby substantially preventing the escape of air from the package while the opposed squeezing forces are being applied. Once the opposed squeezing forces are removed from resilient outer wall 12, the negative pressure created within chamber 13 as the resilient outer wall 12 attempts to return to its substantially undeformed condition will lift the uppermost portion of resilient air check valve 1 away from the base 2 of the package, thereby allowing air to readily enter chamber 13 through aperture 3 until pressure equilibrium with the surrounding atmosphere has been reached.

In the package embodiment illustrated in FIG. 1, the air check valve 1 is held in place by inserting its base 8 through a second hole 6 in the base of the container. A bulbous end (not shown) is preferably employed on base 8 so that the check valve cannot be inadvertently dislodged from the container base once it has been inserted. A raised ring 5 slightly larger in diameter and taller in height than the uppermost portion of air check valve 1 is preferably molded about apertures 3 and 6 to prevent the lowermost surface of the flexible bag 10 from interfering with the operation of the air check valve 1 during dispensing, particularly while the bag is full or nearly full.

Figure 4:
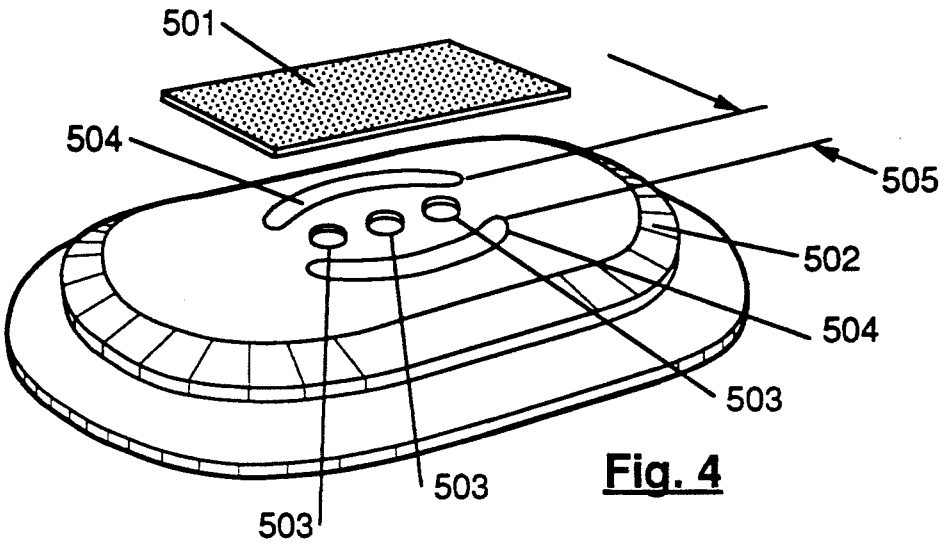
FIG. 4 is an exploded view of a base which may be substituted for the base employed in the prior art dispensing package shown in FIGS. 1, 2 and 3, but employing an air check valve of the present invention, said view being shown in exploded form for clarity.

FIG. 4 is a simplified perspective illustration of a container base 102 including an air check valve of the present invention. The container base 102 and the attached air check valve may be substituted for container base 2 and air check valve 1 in the prior art squeeze bottle dispensing package 50 of FIGS. 1-3 to yield the benefits of the present invention.

The prior art resilient squeeze bottle dispensing package 50 shown in FIGS. 1-3 can ooze a viscous product, such as dentifrice, when the package is rapidly brought to a high elevation. The mechanism that causes the package to ooze at high elevations is the same mechanism that causes the package to function as intended when the consumer squeezes the package: when the air check valve 1 in the base 2 experiences an increase in internal pressure (from squeezing or from an ascent to a higher elevation), it closes. The internal pressure can then continue to increase (either from squeezing with greater force or from ascent to higher and higher elevations). Once a sufficient pressure differential relative to the atmosphere is reached inside chamber 13, viscous product 60 is dispensed through the package's dispensing orifice 20. This typically occurs at differential pressures on the order of about 2 psig.

With most prior art packages of the type disclosed in FIGS. 1-3, a rapid ascent of at least 5,000 feet is normally sufficient to cause the package to ooze. This can occur during air shipment of the package. If the closure is not tightly applied, this can result in the dispensing of much of the package's contents, say in a traveler's suitcase. Even if the package is tightly closed, if the air shipment is to a higher elevation (say from Cincinnati, Ohio to Aspen, Colo.), the package will ooze product whenever the cap is removed, resulting in the loss of control in the dispensing process and unwanted mess on the package, at least until equilibrium with the surrounding atmosphere is reached.

The present invention overcomes the foregoing problem by providing an improved air check valve that functions as does the prior art system shown in FIGS. 1-3 during the brief time (typically about one to about ten seconds) it takes for consumer use, but which automatically permits chamber 13 to reach equilibrium with the surrounding atmospheric air pressure within a period ranging between about 15 minutes and about 6 hours. A number of techniques have been found to achieve this combination of attributes.

Permeable Valve Membrane Approach

Figure 5A:
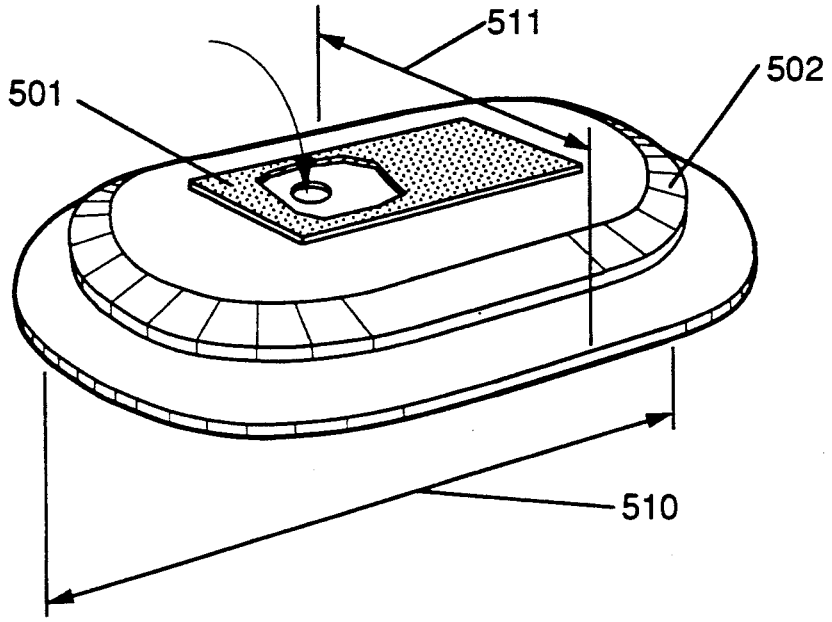
FIG. 5A is a view of the container base shown in FIG. 4 after the air permeable membrane portion of the air check valve has been secured in superposed relation to the apertures in the base.
Figure 5B:
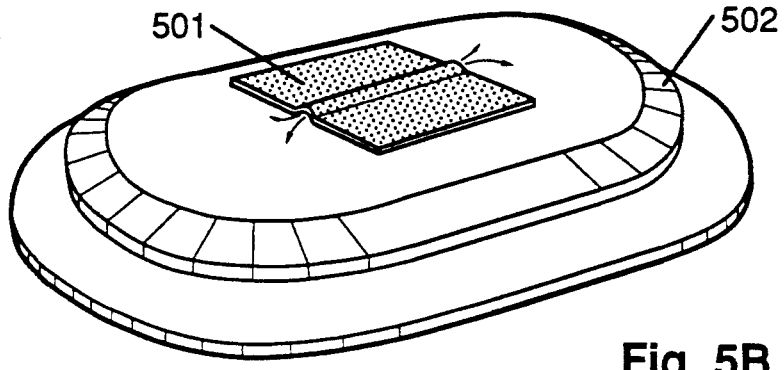
FIG. 5B is a view of the base shown in FIG. 5A illustrating the manner in which the air permeable membrane portion of the air check valve will react to allow air to enter the variable volume chamber formed between the bottom of the flexible bag and the interior of the resilient squeeze bottle after the squeezing forces have been removed from the bottle.

The first technique, which is schematically illustrated in FIGS. 4-5B, utilizes a permeable valve membrane 501 that has a low air permeability so that normal rapid dispensing is possible, but the variable volume chamber 13 formed between the bottom of flexible bag 10 and the interior of the package 50 nonetheless achieves equilibrium with the outside atmosphere within a period of about 15 minutes to about 6 hours after the package is first exposed to the reduced atmospheric pressure.

The rate of air permeability of the valve material can be measured using a Gurley Air Tester Model No. 4190, as available from Teledyne Gurley of Troy, N.Y., with a 1.0 square inch orifice and cylinder weight of 20 oz. This corresponds to an air pressure of about 0.36 inches Hg. The time required for 100 cc of air to pass through the 1.0 square inch of valve material should most preferably be within the range of about 200 seconds and about 10,000 seconds if it is to be used as an air permeable valve membrane 501.

At least two basic types of material have been identified which meet the foregoing requirements. The first comprises a microporous material with a slow rate of leakage through its submicron-sized openings. This valve material provides minimal leakage during the usual consumer use period of about one to about ten seconds, but vents sufficiently to reach equilibrium with the outside atmosphere within the desired 15 minute to 6 hour time range. Exaaire® Breathable Film that is 1–2 mils thick is one such material. This material is available from Exxon Chemical Company of Buffalo Grove, Ill. under the designation Exaaire's Breathable Membrane Film 10B04. The air transmission of a 1.3 mil thick sample of said film, as measured in the previously described Gurley air permeability test, is in the 300–800 seconds/100 cc range. This material may be readily heat sealed or adhesively attached to the base of the package.

A specific application of this approach, as shown in FIGS. 4–5B, comprises:

(a) Container base 502 having a major axis 510 of 1.862" and minor axis 511 of 1.165". Three apertures 503 with diameters of 0.031" are located along the major axis 510. The center aperture is located at the intersection of the major axis 510 and the minor axis 511 and the centerlines of the other two apertures are located 0.094" away from the centerline of the center hole. These three apertures provide approximately 0.00226 square inches of vent area for the air check valve.

(b) Valve material 501 comprises a 1.00" by 0.88" membrane oriented so the 1.00" length is oriented parallel to the major axis 510 of base 502. This material can be heat staked with a pattern comprising a pair of arcs 504. Each arc 504 is centered around the air apertures 503 and has an inside diameter of 0.53", and gaps 505 on each side of 0.50", centered along the major axis 510 of the container base 502. The total cross-sectional area of each arc 504 is approximately 0.102 square inches, yielding a total contact area for the pair of arcs 504 of approximately 0.204 square inches. Using 1.3 mil thick Exxaire® Breathable Film of the type described earlier herein as the valve membrane 501 and a container base 502 made of medium density polyethylene, preferred heat sealing conditions are: anvil temperature of 450° F. at an anvil pressure of approximately 80 pounds per square inch exerted by arc shaped anvils 504 against valve membrane 501 for a time of 1 second. Other heat sealing conditions are, of course, possible.

One measurement of success for sealing is when the valve membrane 501 can be torn by hand off of the container base 502 and there is residue from the valve material left on all of the heat stake pattern areas 504 on the container base.

Alternative configurations for the apertures 503, alternative valve materials 501 and alternative valve staking patterns 504 (e.g., the use of a single arc 504 rather than a pair of arcs 504) are possible, provided they keep the normal package recovery time in an acceptable range so as not to require excessive time for the resilient package to recover between successive squeezes.

FIG. 5A illustrates the position of the valve membrane 501 when the squeezing forces are applieu to the resilient squeeze bottle package to dispense product, while FIG. 5B illustrates the position of the valve membrane 501 immediately after the squeezing forces are removed from the resilient package. In the latter situation, the lower pressure inside the variable volume chamber 13 causes the unsecured central portion of the valve membrane 501 to stretch and lift away from the base 502 containing apertures 503, thereby permitting air flow in the direction of the arrows until equilibrium is reached. The valve membrane 501 thereafter returns to its closed position, as shown in FIG. 5A.

An alternate to the microporous valve material which can also be used for valve membrane 501 comprises a laminated material that contains a very thin film and a thicker, highly porous layer. The film, which may be comprised of 0.7 mil thick polyethylene, is so thin that there are a number of "pin holes" in that layer to achieve the same effect as the microporous material. These holes will tend to be larger than those in the microporous materials (in the micron size range), but are fewer in number and so will result in essentially the same effect. The second layer (such as a spun bonded polypropylene nonwoven) serves as a carrier, providing the needed bulk to allow simpler handling of the extremely thin layer during heat sealing or adhesive attachment of the valve member 501 to the container base 502.

The rate of air transmission with the latter material can cover a broader range than the microporous materials described earlier, the precise rate depending upon the size and number of pin holes in the thin film and also upon the degree of porosity of the carrier.

Heat sealing this arrangement may be more difficult than with the microporous materials, due to the potentially different melt characteristics of the laminated materials. An adhesive attachment using the same pattern as the previously described heat staking pattern 504 is generally acceptable. Whatever attachment method is used, the thin film is preferably oriented so as to be in direct contact with the container base 502, since some of the porous materials which may be used as a carrier will allow immediate leakage through their sides if they are placed in direct contact with the container base, thereby negatively impacting the normal viscous product dispensing cycle.

Resilient Valve Membrane which Undergoes Deformation to Prevent Air Escape

Figure 6:
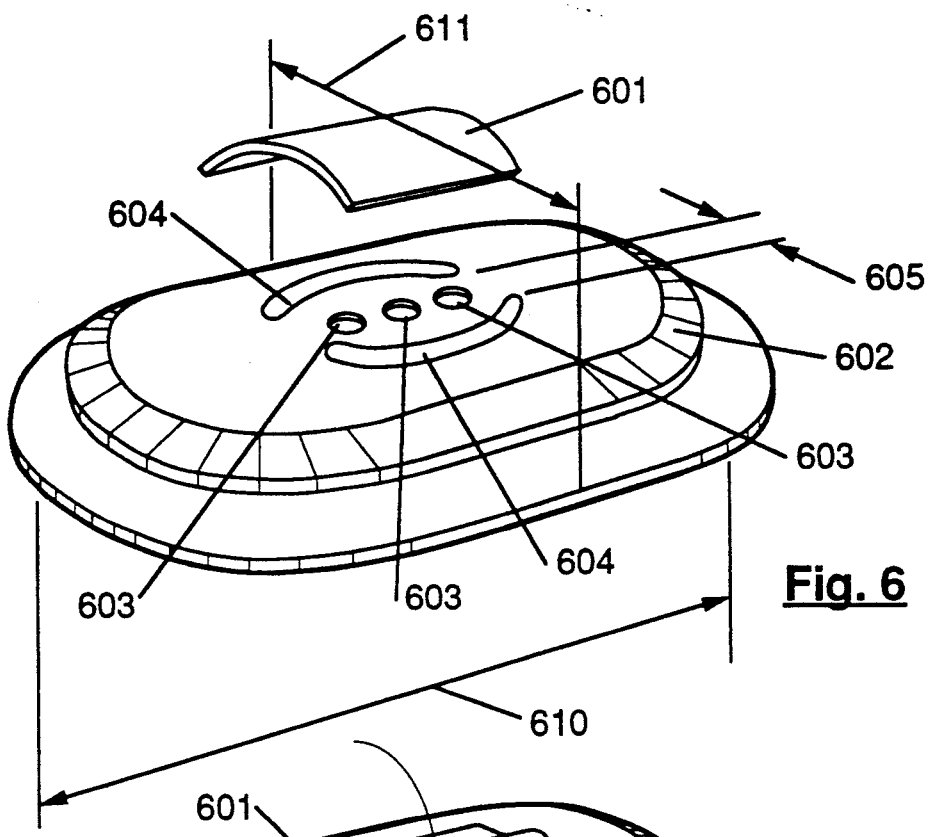
FIG. 6 is a view of a base generally similar to that shown in FIG. 4 employing a resiliently deformable membrane as a portion of the air check valve, said view being shown in an exploded condition for clarity.
Figure 7A:
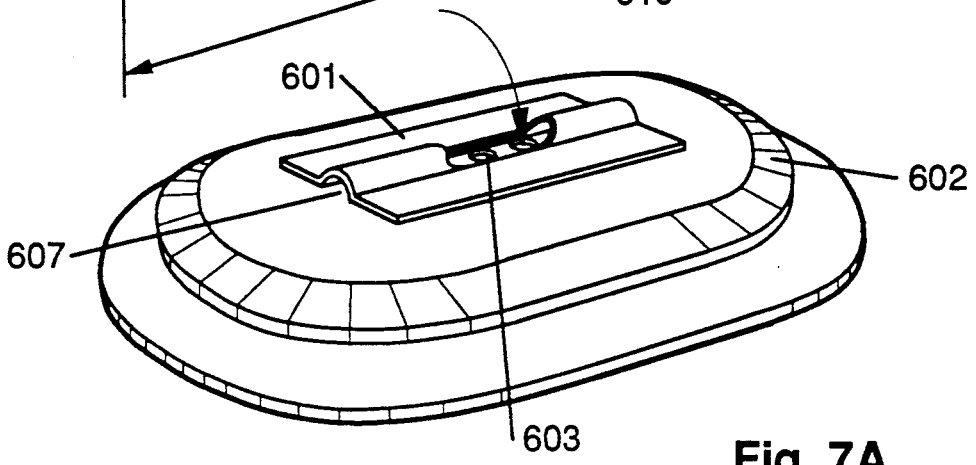
FIG. 7A is a view of the base shown in FIG. 6 after the resiliently deformable membrane has been secured in superposed relation to the apertures in the base, the portion of the membrane coinciding with the apertures in the base exhibiting an upwardly convex shape intermediate the areas of securement of the membrane to the base.
Figure 7B:
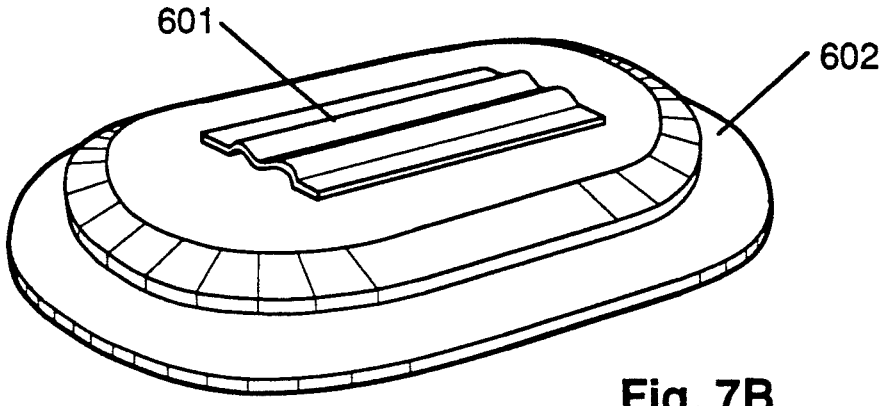
FIG. 7B is a view of the base shown in FIG. 7A illustrating the manner in which the resiliently deformable upwardly convex portion of the membrane is deformed into contacting relation with the container base so as to block the apertures in the container base when a squeezing force is applied to the resilient squeeze bottle package to dispense product through its dispensing orifice.

A second technique for solving the oozing problem described herein relies upon a special method of attachment of the valve material 601 to the base 602 of the package. The normal upwardly arched configuration of the valve material 601, as generally shown in FIGS. 6–7A, allows it to be essentially seated and blocking the base air apertures 603, as generally shown in FIG. 7B, only during the first 0–10 seconds of the squeezing process. As the valve material 601 returns to its equilibrium position, as generally shown in FIGS. 6–7A, leakage in the base air valve system occurs to reach the desired equilibrium with the outside air pressure. This effect can be achieved using either of the methods described hereinafter.

1. Use an impermeable material, such as ethylene vinyl acetate (EVA), that is heat sealed or adhesively attached by arcs 604, as shown in FIG. 6, such that the air valve's upwardly arched vent gap 607 is large enough that it will not completely block apertures 603 in the valve's equilibrium position, as generally shown in FIG. 7A. This allows normal consumer use during squeezing, as shown in FIG. 7B, followed by rapid venting to quickly reach equilibrium with the outside atmosphere.

A specific application of this approach, as shown in FIGS. 6–7A, comprises:

(a) Base container 602 with a major axis 610 of 1.862" and minor axis 611 of 1.165". Three apertures 603 with diameters of 0.031" are located along the major axis 610 of the container base 602. The center aperture is located at the intersection of the major axis 610 and the minor axis 611 and the centerlines of other two apertures are located 0.094" away from the centerline of the center aperture. These three apertures provide approximately 0.00226 square inches of vent area for the air check valve.

(b) Resilient valve membrane 601 comprises a 1.00" by 0.88" membrane oriented so the 1.00" length is oriented parallel to the major axis 610 of the container base 602. This material is heat staked with a pattern comprising two opposed arcs 604. These arcs are centered around the air apertures 603, have an inside diameter of 0.53", and gaps 605 on each side of 0.50", centered along the major axis 610 of the container base 602. The total cross-sectional area of each arc 604 is approximately 0.102 square inches, yielding a total contact area for the pair of arcs 604 of approximately 0.204 square inches. Using 1.25 mil thick ethylene vinyl acetate film, as available from Exxon Chemical Company of Buffalo Grove, Ill. under the designation EVA-2, for valve material 601 and a base 602 made of medium density polyethylene, acceptable heat sealing conditions are: anvil temperature of 350° F. at an anvil pressure of approximately 52 pounds per square inch exerted by arc shaped anvils 604 against valve membrane 601 for a time of 1 sec. Other heat sealing conditions are, of course, possible.

One measurement of success for sealing is when the valve material 601 can be torn by hand off of the base 602, leaving a residue from the valve material on all of the heat stake pattern arc areas 604.

Alternative configurations for the air vent apertures 603, alternative valve membrane materials 601 and alternative valve staking patterns are possible, provided they keep the normal package recovery time between successive squeezes of the package in an acceptable range.

Figure 8:
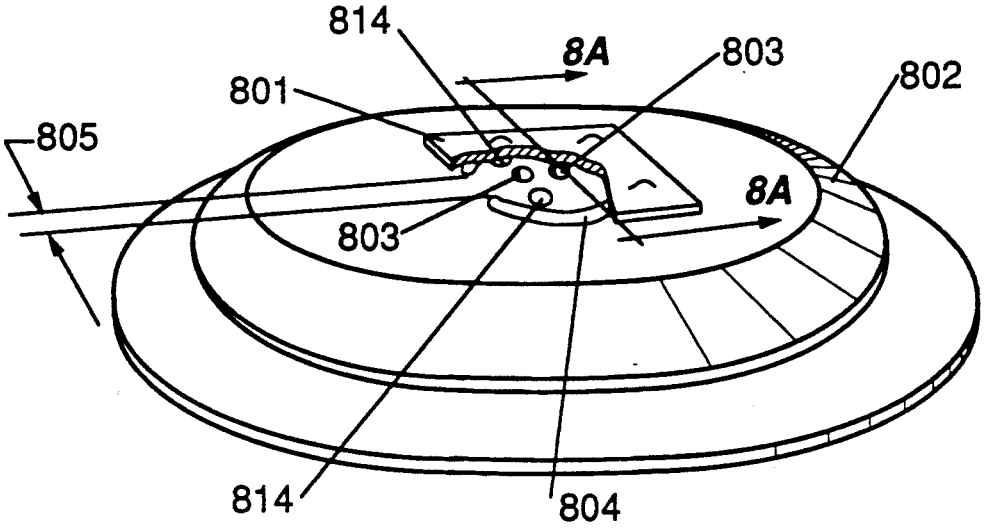
FIG. 8 is a view of a base generally similar to that shown in FIG. 6, but including a multiplicity of protuberances on its uppermost surface.
Figure 8A:
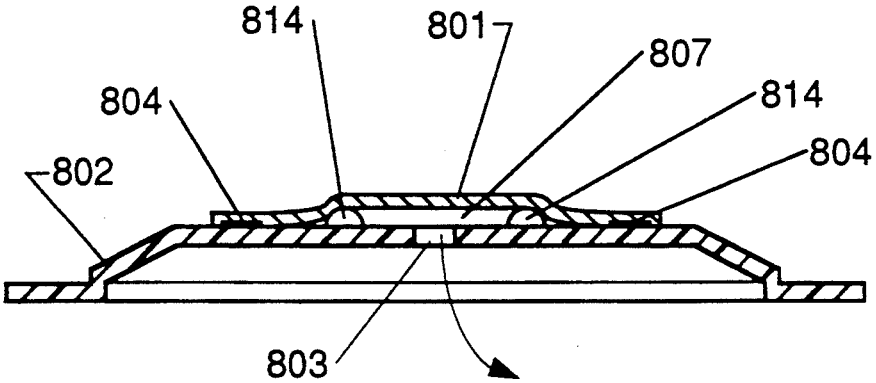
FIG. 8A is a cross-sectional view of the base shown in FIG. 8 taken along section line 8A—8A, said view showing the normal at rest position of the air check valve.
Figure 8B:
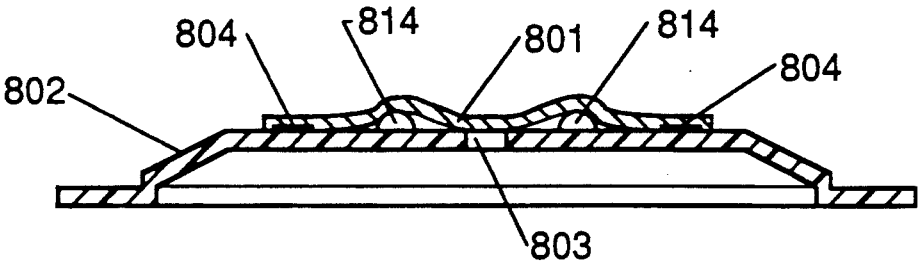
FIG. 8B is a cross-sectional view generally similar to that of FIG. 8A, but showing the position of the air check valve as the package is being squeezed and product is being dispensed from the package.

Still another technique of the aforementioned type for solving the oozing problem described herein relies upon the use of a container base 802 which is in most respects similar to container base 602, but which includes a multiplicity of small raised projections 814 beneath the valve material 801. The latter valve embodiment is illustrated in FIGS. 8–8B. The raised projections 814 on the container base 802 cause the formation of a very small channel 807 between the lowermost surface of the valve material 801 and the substantially planar surface of the container base 802. As with the valve embodiment shown in FIGS. 7–7B, this channel will collapse to allow normal consumer use of the package during squeezing, as shown in the cross-section of FIG. 8B, but will vent the package quickly to reach equilibrium with the outside atmosphere when the product dispensing cycle has been completed and the valve returns to its equilibrium position, as generally shown in FIG. 8A.

The projections 814 on container base 802 are preferably located under the lowermost surface of the valve material 801 inside the areas of valve securement or staking patterns 804, but are preferably not within the staking gap 805.

In the embodiment illustrated in FIG. 8, a total of four such projections 814 are shown. In an exemplary embodiment of this type, the projections 814 exhibited a round cross-section measuring approximately 1/32" in diameter and a height of approximately 1/32". They were positioned so that they were not between adjacent apertures 803 nor in the gap formed between the staking patterns 804. Alternate patterns and shapes for the projections 814 are of course possible, depending upon the size of the particular projections employed.

When projections 814 are used in the manner disclosed in FIG. 8, the valve material 801 is normally staked in position in a substantially planar configuration as opposed to the upwardly arched configuration generally shown in FIG. 7A. The equilibrium position of the valve is generally shown in the cross-section of FIG. 8A. As can be seem in the cross-section of FIG. 8B, the valve material 801 deforms sufficiently to block the apertures 803 in container base 802 during the normal product dispensing cycle, yet quickly returns to the equilibrium position shown in FIG. 8A to a venting channel 807 once the dispensing cycle has been completed.

It is of course recognized that the present invention can be practiced to advantage utilizing many alternative configurations of projections or depressions and/or combinations thereof in container base 802. For example, stippling of the container base 802 in the immediate vicinity of venting apertures 803 could be provided to accomplish a result generally similar to that of projections 814. Whatever their form, these irregularities must, in general, be sized and configured so that the valve material 801 can deform and substantially block the passage of air through the venting apertures 803 in the container base 802 when the package is squeezed for normal dispensing, yet allow one or more venting passageways 807 to form between the uppermost surface of the container base 802 and the lowermost surface of the valve membrane 801 after the product dispensing cycle has been completed.

Figure 9:
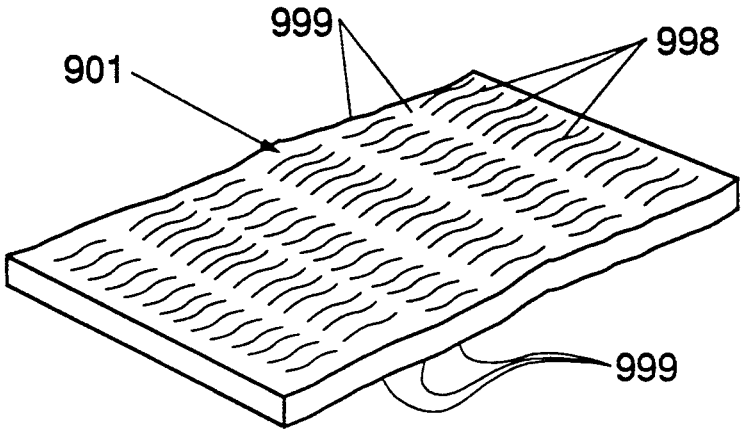
FIG. 9 is a simplified perspective view of another resiliently deformable membrane which can be employed in the practice of the present invention.
Figure 9A:
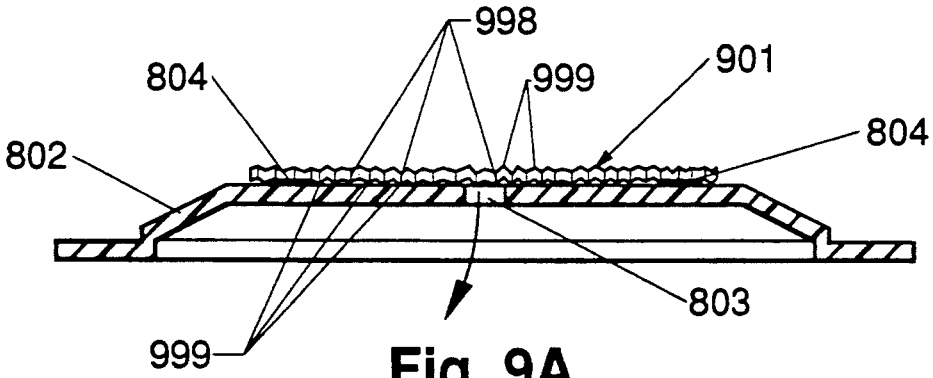
FIG. 9A is a cross-sectional view of the valve membrane of FIG. 9 secured to a container base of the type shown in FIG. 8, said valve membrane being shown in its at rest condition.
Figure 9B:
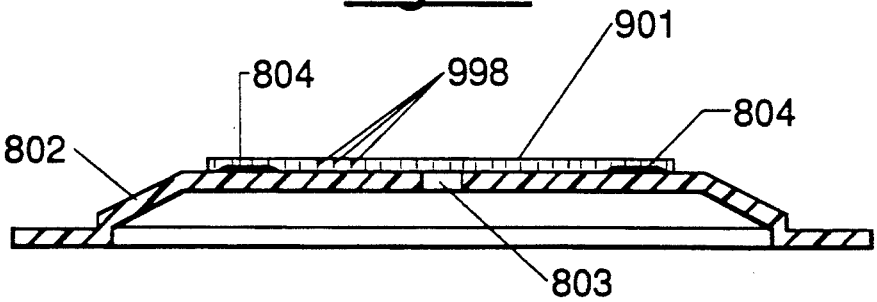
FIG. 9B is a cross-sectional view showing the valve membrane of FIG. 9A when the package is being squeezed to dispense product.

Resilient Valve Membrane Having A Lowermost Surface which is Substantially Non-Planar Still another technique for providing a breathable dispensing package of the present invention is based upon a combination of the techniques described earlier herein. In particular, the valve membrane 901, as shown in FIGS. 9, 9A and 9B, can be comprised of a material which is substantially impervious to the passage of air, but which can nonetheless be made to function in a satisfactory manner by creating tiny vertical discontinuities 999 in its lowermost surface. For example, an EVA film may be laser apertured or manually slit (as at 998) to create a multiplicity of tiny vertical discontinuities 999 along its uppermost and lowermost surfaces. The slits or apertures 998 not only impart some degree of permeability through the thickness of the film, but in addition cause the lowermost surface of the film 901 which ultimately is placed in contact with the uppermost planar surface of the container base 802 to become substantially non-planar in the normal at rest condition of the membrane, i.e., see discontinuities 999 in Drawing FIG. 9A.

However, when the package is rapidly squeezed, the suddenly applied internal pressure tends to force the lowermost surface of the film 901 into a substantially planar condition, as generally shown in Drawing FIG. 9B, thereby minimizing any irregularities existing between the uppermost surface of the container base 802 and the lowermost surface of the valve membrane 901. Although some air may pass through the thickness of the film via any slits or apertures 998 which happen to coincide with the apertures 803 in the container base 802, the substantial flattening of the membrane 901 tends to prevent the escape of air through apertures 803 via the lowermost surface of the substantially flattened membrane 901 and the uppermost surface of the container base 802, thereby facilitating dispensing of viscous product from the package.

When the squeezing forces are removed from the package, the slit or apertured membrane 901 is free to assume its at rest substantially non-planar condition. This not only permits rapid entry of air from the surrounding atmosphere into the package through apertures 803 at the end of each squeezing cycle, but, in the absence of suddenly applied squeezing forces, permits slow equilibration between the variable volume chamber within the package and the surrounding atmosphere whenever the atmospheric pressure surrounding the package decreases.

One valve material that can be used for membrane 901 can comprise a normally non-breathable polymeric film, such as 1.25 mil thick ethylene vinyl acetate (EVA), which has been finely apertured by means well known in the art, e.g., a $CO_2$ laser. When such a technique is employed to produce a closely nested pattern of apertures having a diameter in the 3 to 3½ mil size range, each aperture being spaced approximately 64 mils from all adjacent apertures, package operating characteristics generally similar to those obtained using the Exxaire® Breathable Film described earlier herein can be obtained.

In the event laser aperturing equipment is not available, the film in question can be prepared by slitting it manually with an Exacto knife with a pattern of substantially parallel slits, each having a length of approximately 118 mils, said slits being spaced approximately 118 mils apart as measured in a direction parallel to their length and approximately 197 mils apart as measured in a direction perpendicular to their length. The slits are preferably provided in all areas of the valve membrane except those directly coinciding with the apertures 803 in the container base 802.

Vacuum Test Criteria for Preferred Packages

An analytical test that has proven helpful in predicting the suitability of a given material/attachment system for use in resilient squeeze bottle dispensing packages of the present invention involves inserting a resilient squeeze bottle package of the present invention containing the dentifrice of interest into a standard vacuum chamber. For the various formulations of Crest® dentifrice currently manufactured and sold by The Procter & Gamble Company of Cincinnati, Ohio, the viscosity of the different dentifrice formulations typically ranges between about 10 and about 27 Brookfield units as measured on a Model No. ½ RVT Brookfield Viscometer, as available from Brookfield Engineering Labs, Inc. of Stoughton, Mass.

1. The filled package is initially squeezed to dispense product several times with an applied squeezing force in the range of about 6 to about 25 pounds to confirm that it will satisfactorily dispense product. This force can, if desired, be measured using an Accuforce Cadet Force Gauge, as available from Hunter Spring Division of Ametek of Hatfield, Pa. If the package does not properly dispense product, the most common reason is that the air valve is permitting air to escape too rapidly from the variable volume chamber in the package. It will be appreciated that the package in question must exhibit a satisfactory product dispensing characteristic prior to placement in the vacuum chamber or it will be of no importance that it pass the vacuum testing procedure described hereinafter.

2. After successfully passing the dispensing test of step 1, the package is placed, without its closure, into the vacuum chamber. The vacuum inside the chamber is slowly increased over a period ranging from about 2 minutes to about 5 minutes to about 4" Hg and is then stabilized at about 4" Hg for approximately 30 seconds. No oozing of the package contents should occur at this point.

3. The vacuum inside the chamber is thereafter slowly increased over a period of about 5 minutes to about 9" Hg.

4. If no oozing of the package contents occurs when the package is subjected to 4" Hg vacuum, or only minimal oozing (no more than about a 1" long dollop for a discharge orifice which measures approximately 0.281" in diameter) occurs at 9" Hg vacuum, but stops within 1 minute of reaching 9" Hg vacuum within the vacuum chamber, then the check valve material/attachment system is generally considered to be acceptable for use in breathable packages of the present invention.

While the present invention has been described in the context of a resilient squeeze bottle dispensing package particularly well suited for dispensing dentifrice paste, it is recognized that the present invention may be practiced to advantage in many other environments where controlled dispensing of a viscous product is desired. It is further recognized that the specific design of many of the structural elements employed may vary from one application to another. It will be obvious to those skilled in the art that various changes and modifications can be made to the present resilient squeeze bottle dispensing package and vent valve without departing from the spirit and scope of the present invention, and it is intended to cover in the appended claims all such modifications that are within the scope of this invention.

What is claimed is:

1. In a resilient squeeze bottle package for dispensing a viscous product contained within a flexible bag inside said resilient squeeze bottle package, said flexible bag being connected to a discharge orifice in said squeeze bottle, said bottle including means for automatically substantially preventing the rapid exit of air from a variable volume chamber formed between said flexible bag and the inside of said squeeze bottle whenever squeezing forces are applied to said resilient squeeze bottle package to dispense said viscous product through said discharge orifice yet allow atmospheric air to rapidly enter said chamber when said squeezing forces are removed from said resilient squeeze bottle package, the improvement wherein said means comprises an independent air check valve comprising a permeable membrane movably secured in superposed relation over at least one aperture in said resilient squeeze bottle, whereby the application of manual squeezing forces to said bottle causes said permeable membrane to rapidly block said aperture in said squeeze bottle and thereby develop a pressure differential sufficient to dispense viscous product through said discharge orifice, at least a portion of said permeable membrane being caused to move away from said aperture in said squeeze bottle by the pressure differential created between the surrounding atmosphere and said chamber when the manual squeezing forces are removed from said bottle, thereby permitting atmospheric air to rapidly enter into said chamber through said aperture until pressure equilibrium between said chamber and the surrounding atmosphere has been achieved, said membrane exhibiting a sufficient degree of permeability that air trapped in said chamber can gradually pass therethrough and out said aperture blocked by said membrane to permit equilibration of the pressure in said chamber with that of the surrounding atmosphere before the pressure differential caused by a gradual decrease in the surrounding atmospheric pressure becomes sufficient to cause uncontrolled oozing of viscous product from said discharge orifice.

2. The improved squeeze bottle package of claim 1, wherein said permeable membrane comprises a microporous structure.

3. The improved squeeze bottle package of claim 1, wherein said permeable membrane comprises a layer of substantially impermeable material containing a multiplicity of apertures in the micron size range.

4. The improved squeeze bottle package of claim 1, wherein said permeable membrane comprises a layer of substantially impermeable material containing a multiplicity of slits.

5. The improved squeeze bottle package of claim 1, wherein said permeable membrane comprises a laminated material including a thin film layer containing a multiplicity of pin holes secured to a nonwoven carrier layer.

6. The improved squeeze bottle package of claim 5, wherein said permeable membrane is secured in superposed relation over said aperture so that the thin film surface of said laminated material substantially blocks said aperture when said resilient package is squeezed to dispense product.

7. The improved squeeze bottle package of claim 1, wherein a 1.0 square inch sample of said membrane will pass 100 cubic centimeters of air in between about 200 and about 10.000 seconds, as measured on a Gurley Air Tester Model No. 4190 using a 1.0 square inch orifice and a cylinder weight of 20 ounces.

* * * * *

UNITED STATES PATENT AND TRADEMARK OFFICE

CERTIFICATE OF CORRECTION

PATENT NO. : 5,318,204

DATED : June 7, 1994

INVENTOR(S) : Davis et al.

It is certified that error appears in the above-indentified patent and that said Letters Patent is hereby corrected as shown below:

On the Title Page, item [73] Assignee, "Proctor" should read --Procter--.

In the References Cited section Patent No. 3,319,837 "1/1967" should read -- 1/1965 -- .

Column 7, line 22, "Exaaire's" should read -- Exaaire® -- .

Column 14, line 23, "10.000" should read -- 10,000 -- .

Signed and Sealed this

Fifteenth Day of August, 1995

Bruce Lehman

*Attest:*

BRUCE LEHMAN

*Attesting Officer*

*Commissioner of Patents and Trademarks*